US005546689A

United States Patent [19]

Bomze

[11] Patent Number: 5,546,689

[45] Date of Patent: Aug. 20, 1996

[54] ADJUSTABLE PICTURE FRAME

[76] Inventor: Daniel Bomze, 835 Waverly St., Palo Alto, Calif. 94301

[21] Appl. No.: 349,678

[22] Filed: Dec. 5, 1994

[51] Int. Cl.[6] ..... G09F 1/12

[52] U.S. Cl. ..... 40/741; 40/739

[58] Field of Search ..... 49/505; 52/204.56, 52/217, 745.15, 745.16; 40/739, 741, 742, 781

[56] References Cited

U.S. PATENT DOCUMENTS

| | | | |
|---|---|---|---|
| 577,530 | 2/1897 | Lee . | |
| 579,243 | 3/1897 | Schulze | 40/156 X |
| 723,497 | 3/1903 | Strauss . | |
| 908,170 | 12/1908 | Van Der Boom | 40/155 |
| 933,388 | 9/1909 | Peticore . | |
| 1,308,695 | 7/1919 | Bushkovski | 40/155 X |
| 1,446,900 | 2/1923 | Hintz . | |
| 1,524,793 | 2/1925 | Lemery | 40/155 |
| 1,540,482 | 6/1925 | Landaal | 40/155 |
| 2,442,967 | 6/1948 | Barash et al. | 40/155 |
| 4,989,353 | 2/1991 | Astolfi | 40/152 X |

*Primary Examiner*—Brian K. Green

*Attorney, Agent, or Firm*—Armstrong, Teasdale, Schlafly & Davis

[57] ABSTRACT

An adjustable picture frame for adjustably fitting around a picture, comprising a first upper framing member having an adjustable wall portion, a second framing member having a series of interconnected adjustable walls, fastening members for securing the first framing member to the second framing member, a display member for holding a picture between the first and second framing members, selective positioning members for positioning the display member between the first and second framing members in a plurality of positions, whereby the adjustable walls adjustably fit over a plurality of portions of the display member.

3 Claims, 4 Drawing Sheets

ADJUSTABLE PICTURE FRAME

BACKGROUND OF THE INVENTION

1. Field of the Invention

The present invention relates to picture frames, and more particularly to an adjustable picture frame which adjusts to accommodate various sizes of pictures.

2. Related Art

Picture frames most commonly used in the framing industry typically have fixed predetermined dimensions to accommodate a specific size of picture. Accordingly, subsequent re-use of these frames is restricted to pictures being of sizes which correspond to the predetermined frame dimensions. Therefore, as different sizes of pictures are acquired, similarly sized frames must also be acquired. However, use of these frames is still limited in that some pictures have unique dimensions which do not fit into standard size frames. Another limitation of the commonly known picture frames is that they only provide for uniform picture placement. More specifically, the sides of the commonly known frames are adapted to align with the immediate edges of a picture so that the frame covers a uniform distance inwardly from each edge. Unfortunately uniform frame dimensions preclude placement of a picture in a position which is biased towards one side of the frame, i.e., covering one edge of a picture more than another. As a result, aligning an off-centered picture within the commonly known frames often requires cropping of the picture.

One attempt to overcome the limitations mentioned above is to provide an adjustable picture frame in which the dimensions of the frame are increased or decreased accordingly to accommodate various sizes of pictures. For example, U.S. Pat. No. 577,530 discloses a picture frame which uses lazy-tongs comprising a series of unidirectional strips hinged at center points for longitudinal movement together or apart to shorten or lengthen the sides of the frame. The lazy-tongs move to adjustably fit the frame around a picture. Furthermore, the picture frame has four corner sections which each include a pocket for receiving the corners of the picture. The lazy-tongs are provided with end slots for receiving a bolt which pivotally connects the lazy-tongs to each corner section. Thus, as the lazy-tongs move longitudinally together or apart the corners of the frame also move to fit the frame around a picture.

In another example, U.S. Pat. No. 723,497, an adjustable picture frame which comprises four L-shaped adjacent corner sections is disclosed. Each L-shaped corner section has a pair of arms provided with kerfs comprising horizontally extending grooves and ribs which are positioned to engage the kerfs and ribs of an arm of an adjacent L-shaped corner section. A band provided with set screws slides on the outer ribs of each arm for adjustably securing the L-shaped corner sections in position. The frame size is decreased or increased by sliding the respective kerfs and ribs inwardly or outwardly accordingly.

Similarly, U.S. Pat. No. 933,388 discloses an adjustable frame having four corner sections which are slidably connected to intervening telescoping outer sections. Each intervening telescoping outer section may be completely inserted within a corner section or extended a predetermined amount outwardly to decrease or increase the frame size.

Although the above-mentioned adjustable frames serve the intended purpose of providing a frame which adjusts to accommodate several sizes of pictures, their use is limited to pictures that are well-centered. In addition, these adjustable frames are complex to assemble in that they require several different pieces to provide for adjustability. Moreover, they only provide for pictures to be displayed on one side of the frame and require exterior stands for vertically supporting the frame. Furthermore, they fail to provide for protection of pictures placed within the frames. Thus, in order to protect the surface of a picture in the traditional manner, several pieces of glass or other protection materials must be custom cut to accommodate each adjustment of frame size.

There exists a need for an adjustable picture frame which may adjustably surround a picture and center a picture within the frame without the need for cropping the picture. In addition, there exists a need for an adjustable picture frame that does not require several sizes of glass or other picture protection materials to be cut with each frame size adjustment. And there also exists a need for an adjustable picture frame that is easy to manufacture and assemble.

SUMMARY OF THE INVENTION

It is therefore among the objects and advantages of this invention to provide an adjustable picture frame which adjusts to center a picture without requiring cropping of the picture.

Still another object of this invention is to provide an adjustable picture frame which is self-supporting and does not require a stand for support purposes.

Another object of this invention is to provide an adjustable picture frame which is reversible and capable of displaying pictures on both sides of the frame.

A further object of this invention is to provide an adjustable picture frame which includes a uniformly sized picture protection member which accommodates a plurality of frame sizes as adjusted.

A still further object of this invention is to provide an adjustable picture frame which comprises only a few pieces and moving parts for facilitating adjustment.

Yet another object of this invention is to provide an adjustable picture frame which is easy to manufacture and is cost-effective.

In accordance with this invention, generally stated, an adjustable picture frame comprising a first framing member having a series of interconnected adjustable walls defining an opening for displaying a picture, a second framing member having a series of interconnected adjustable walls defining an opening for displaying a picture, fastening members for securing the adjustable walls of the first framing member to the adjustable walls of the second framing member, a display member for holding a picture between the first and second framing members, selective positioning members for positioning the display member between the first and second framing members in a plurality of positions, wherein the selective positioning members are integrally located on at least one of the framing members. Whereby the adjustable walls adjustably fit over a plurality of portions of the display member.

Other objects will be apparent or are pointed out in the following description.

DETAILED DESCRIPTION OF PREFERRED EMBODIMENTS

Figure 1:
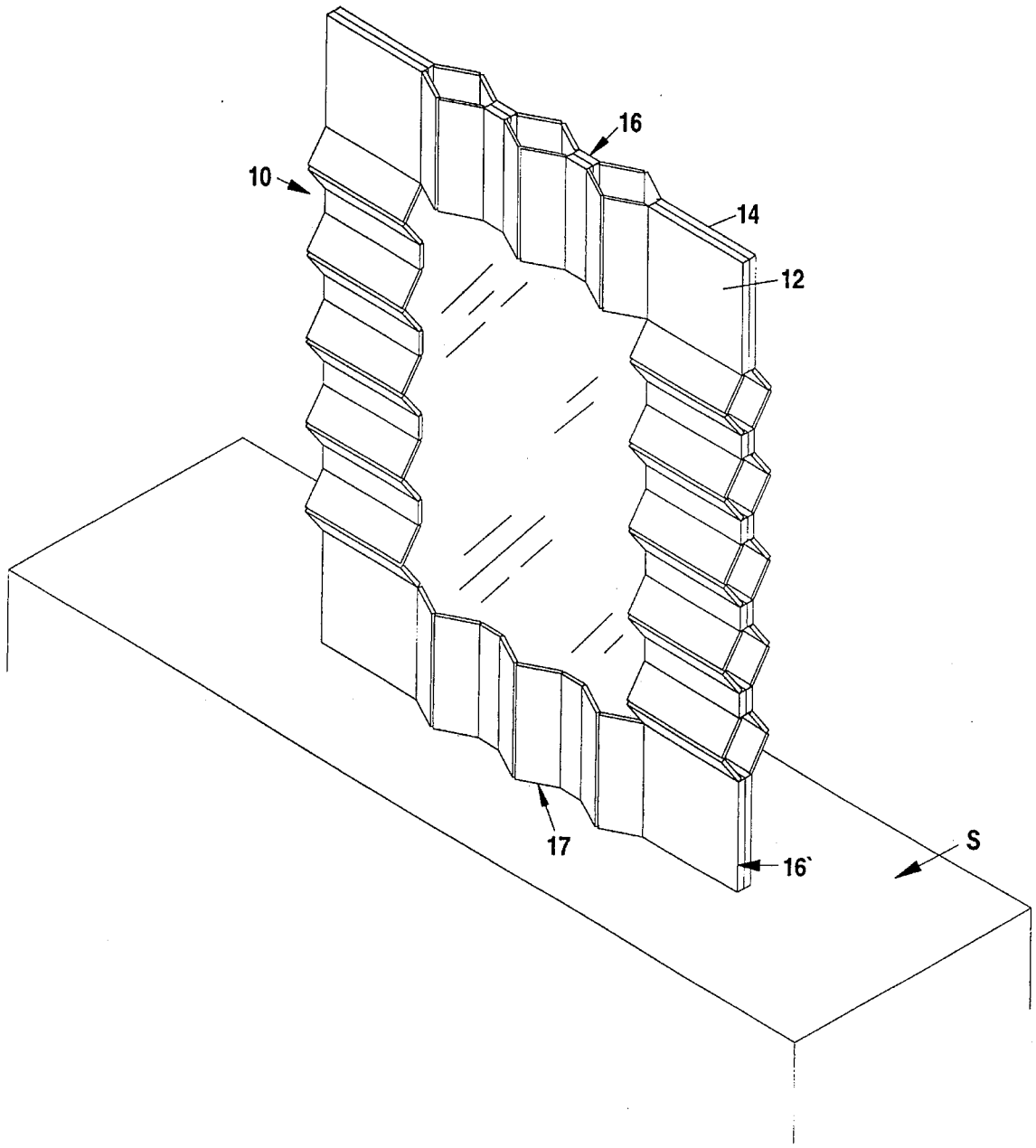
FIG. 1 is a perspective view of an adjustable picture frame constructed in accordance with and embodying the present invention being supported on a flat surface.

Referring now to the drawings for one illustrative embodiment of an adjustable picture frame, reference numeral 10 indicates a completed assembly which embodies the invention described herein.

In the embodiment shown in FIG. 1, the adjustable frame 10 is shown in an upright position for vertically displaying a picture. Adjustable frame 10 includes two matched pieces comprising a first framing member 12 and a second framing member 14 each having a flat outer planar surface 16 and 16'. Outer planar surfaces 16 and 16' provide an edge 17 for supporting adjustable frame 10 in an upright manner on each side of adjustable frame 10. Thus adjustable frame 10 may be vertically supported in a stable position thereby displaying a picture without requiring additional parts such as a stand or other exteriorly attached pieces for support purposes. As shown in FIG. 1, adjustable frame 10 is supported in an upright position on a flat surface S by outer planar surfaces 16 and 16' which form edge 17. Adjustable frame 10 is thereby not limited to one position for displaying pictures since all outer planar surfaces 16 and 16' form edge 17 and thus are suitable as a base. Accordingly, adjustable frame 10 displays pictures using all sides of the frame as a base to include both portrait and landscape positions.

Figure 2:
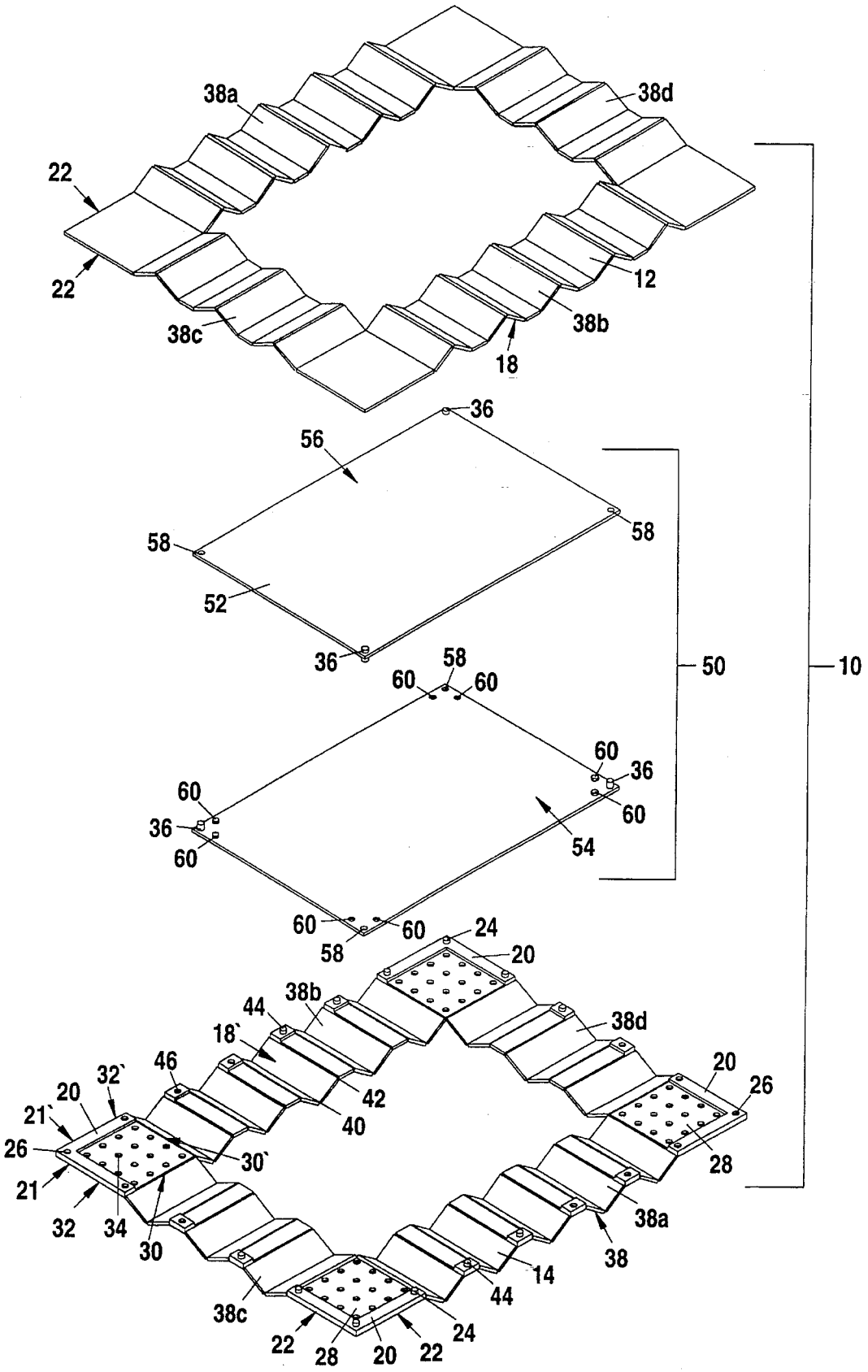
FIG. 2 is an exploded view of the adjustable picture frame of FIG. 1.
Figure 3:
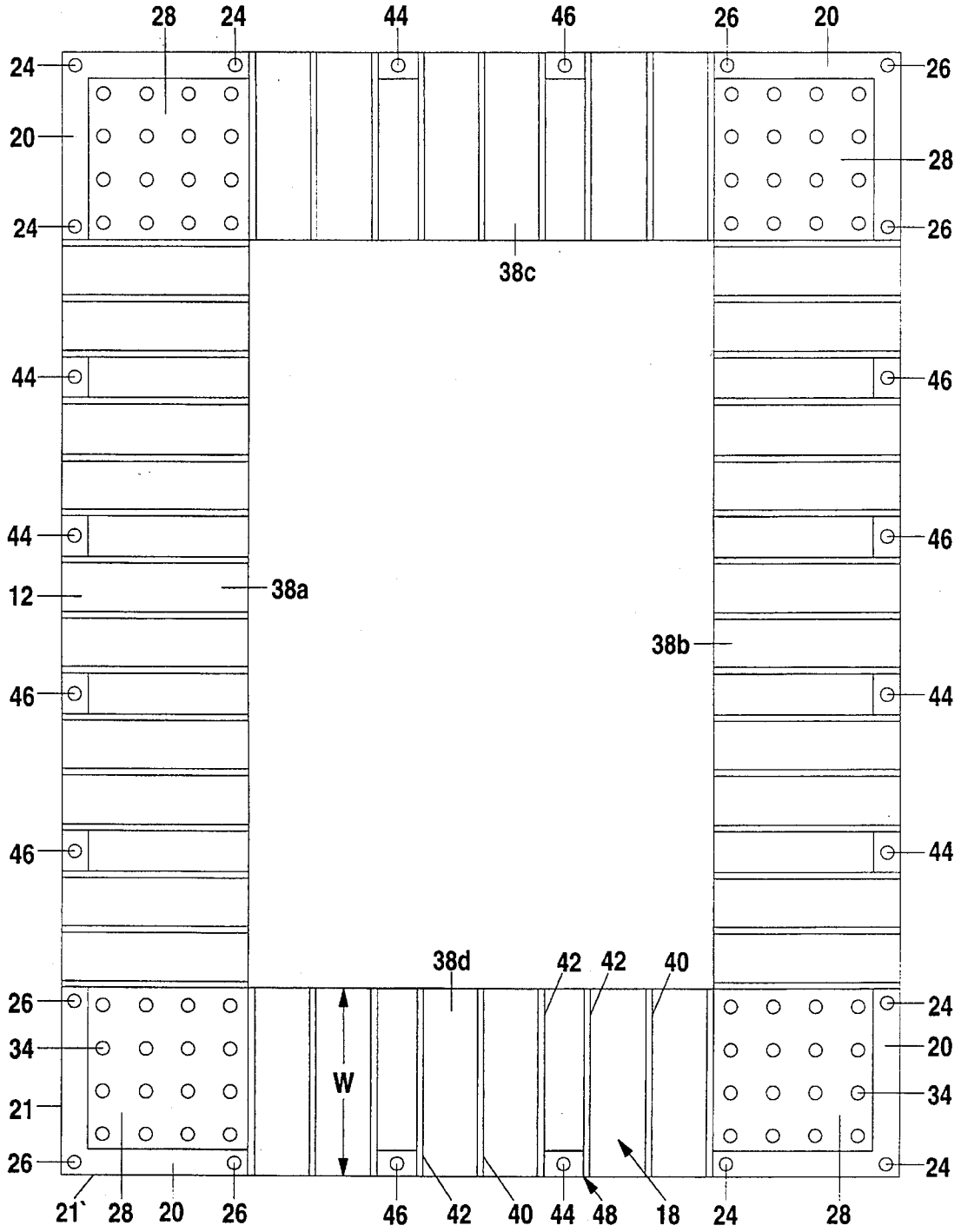
FIG. 3 is a bottom plan view of a first framing member of the adjustable picture frame.

In the embodiment shown in FIG. 2, first framing member 12 and second framing member 14 have identical dimensions. More specifically, first framing member 12 and second framing member 14 are interchangeable and adapted to concisely align with one another when joined together to form outer planar surfaces 16 and 16'. FIG. 3 illustrates the inner surface 18 of first framing member 12 which is identical to the inner surface 18' of second framing member 14. This embodiment of adjustable frame 10 provides for simplicity in manufacture in that first framing member 12 and second framing member 14 may be machined simultaneously.

Figure 4:
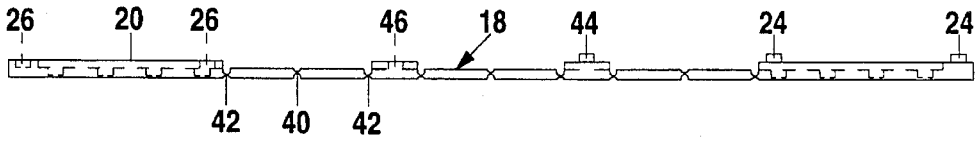
FIG. 4 is a side elevation view of the first framing member of FIG. 3.

As shown in FIG. 2, each framing member is provided with four L-shaped corner attachment sections 20 located on outer corner edges 22 of first and second framing members 12 and 14. FIGS. 3 and 4 illustrate L-shaped corner attachment sections 20 on first framing member 12. L-shaped corner attachment sections 20 are provided alternatively with cylindrical securing pins 24 and receiving apertures 26 for attaching first and second framing members together. As noted above, in the preferred embodiment first and second framing members are identical, thus when inner surfaces 18 and 18' are facing each other, each cylindrical securing pin 24 of first framing member 12 aligns with a corresponding receiving aperture 26 of second framing member 14 for secure attachment thereto. Similarly, each receiving aperture 26 of first framing member 12 aligns with a cylindrical securing pin 24 of second framing member 14.

First and second framing members 12 and 14 are further provided with essentially square locator grids 28 having a pair of inner edges 30,30' and a pair of outer corner edges 32,32' as shown in FIG. 2. Outer corner edges 32,32' are matched in alignment with the outer edges 21,21' of L-shaped corner attachment sections 20 of first and second framing members 12 and 14. Each essentially square locator grid 28 has a series of internal circular apertures 34 extending a predetermined distance downwardly through the inner surfaces 18,18' of first and second framing members 12 and 14. Internal circular apertures 34 are adapted to receive a locator pin 36 as hereinafter more fully discussed.

The adjustable frame 10 includes a plurality of expandable accordion-like adjustable walls 38 which extend outwardly from inner edges 30,30' of essentially square locator grids 28. More specifically, accordion-like adjustable walls 38 comprise a series of vertical expandable wall portions **38*a* and 38*b*, and a series of horizontal expandable wall portions 38*c* and 38*d*, as shown in FIGS. 2 and 3 and hereinafter more fully described. Expandable accordion-like adjustable walls 38 include alternating internal crest hinges 40 and attachment hinges 42 which extend laterally across the width W of first and second framing members 12 and 14. Internal crest hinges 40 and attachment hinges 42 provide for self-spacing so that as expandable accordion-like adjustable walls 38 are adjusted, each hinge moves the same distance to maintain a uniform wall thickness from end to end. As shown in FIG. 4, attachment hinges 42 are alternatively provided with tacking members 44 and receiving slots 46 located on the outer edges 48 of expandable accordion-like adjustable walls 38. Each tacking member 44 of first framing member 12 is aligned with a receiving slot 46 of second framing member 14 and securely fastened thereto. Similarly, each receiving slot 46 of first framing member 12 is aligned with a tacking member 44 of second framing member 14. In the preferred embodiment, first and second framing members are formed of polypropylene, polyethylene, cardboard or other materials which provide for internal hinges which readjust without breakage. In addition, the outer surfaces of first and second framing members are suitable for displaying designs, or other exterior decorative attachments as desired. For example, strips of metal, wood or other materials may be affixed between hinges on expandable accordion-like adjustable walls 38** to vary the exterior frame appearance.

In the embodiment shown in FIG. 2, a display member 50 includes a rectangular top transparent plate 52 and a rectangular bottom transparent plate 54 for displaying a picture. It is preferred for these purposes that rectangular top and bottom transparent plates are formed of transparent materials such as acrylic or glass, but other various transparent materials such as polycarbonate may be utilized. Display member 50 is interposed between the first and second framing members 12 and 14. Display member 50 includes four locator pins 36 extending perpendicularly through the outer surfaces 56 of rectangular top and bottom transparent plates 52 and 54. In embodiment one, each locator pin 36 is positioned on a corner of rectangular top transparent plate 52. A rectangular bottom transparent plate 54 includes four receiving holes 58, one positioned in each corner for securely receiving each locator pin 36 of rectangular top transparent plate 52. In another embodiment shown in FIGS. 2, and 5 a pair of locator pins 36 are positioned at diagonal corners of top transparent plate 52 and another pair of locator pins 36 are positioned at diagonal corners of bottom transparent plate 54. Receiving holes 58 are positioned at opposite diagonal corners of top and bottom rectangular transparent plates for securely receiving respective locator pins 36. In both of the above-mentioned embodiments, four locator pins 36 extend through outer surfaces 56 of the plates. Thus, in addition to securing top and bottom transparent plates together, locator pins 36 provide for selective positioning of display member 50 on essentially square locator grids 28. In particular, locator pins 36 are adapted to be received in internal circular apertures 34 of essentially square locator grids 28. Each internal circular aperture 34 receives a locator pin 36 which maintains display member 50 in a position between first and second framing members 12 and 14.

Figure 5:
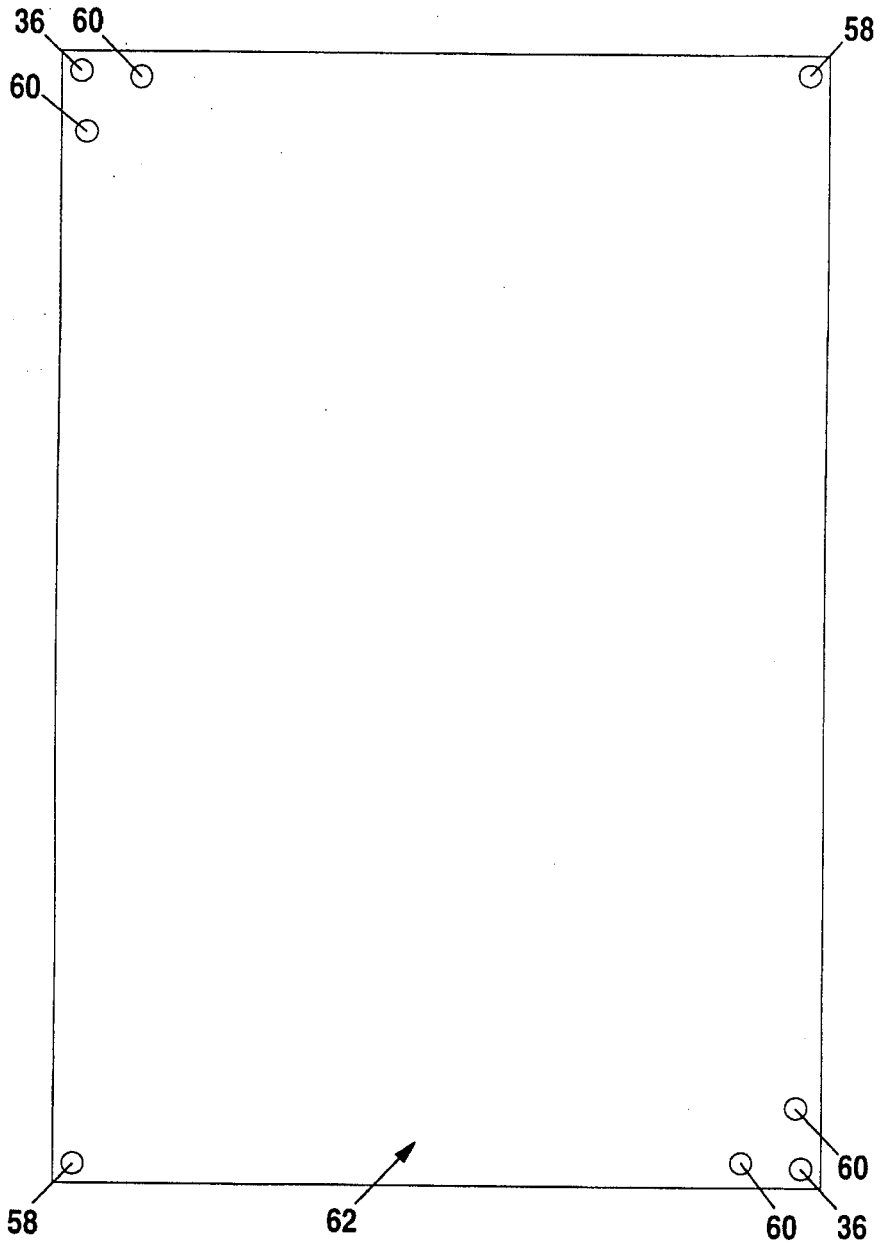
FIG. 5 is a top plan view of a display member plate of the adjustable picture frame.
Figure 6:
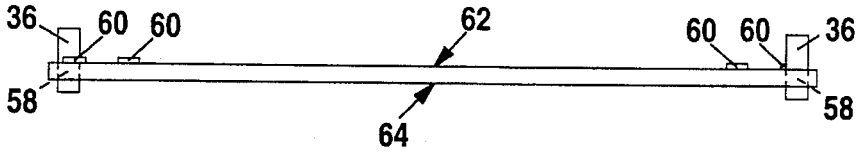
FIG. 6 is a side elevation view of the display member plate of FIG. 5.

In the embodiment shown in FIGS. 2, 5 and 6, each rectangular transparent plate is further provided with centering pins 60. Centering pins 60 extend upwardly from the inner surfaces 62 of the rectangular transparent plates a predetermined distance which does not interfere with securing the plates together. Centering pins 60 center a picture having dimensions corresponding to the largest size provided for by adjustable frame 10. In a preferred embodiment, adjustable frame 10 may accommodate a picture having dimensions up to four inches by six inches, however larger and smaller frame sizes with corresponding display members may also be manufactured.

In operation, a picture is placed face down on an inner surface 62 of top or bottom rectangular transparent plate for placement within first and second framing members. Since both top and bottom rectangular plates are transparent, one picture may be placed face down on rectangular top transparent plate 52 and a second picture may be placed face down on rectangular bottom transparent plate 54 for simultaneous dual picture display. Rectangular top transparent plate 52 is securely attached to rectangular bottom transparent plate 54 by aligning the locator pin 36 on one transparent plate with a receiving hole 58 on the other transparent plate and pressing the plates together. Display member 50 is positioned between first and second framing members 12 and 14 by inserting locator pins 36 into a selected internal circular aperture 34 on essentially square locator grid 28. A picture may be positioned as desired by selecting the internal circular aperture 34 which positions display member 50 most appropriately within adjustable frame 10. Thus, a picture can be offset relative to each corner of adjustable frame 10. Once display member 50 has been positioned within adjustable frame 10, expandable accordion-like adjustable walls 38 are secured around the outer edges 64 of display member 50 by pressing respective tacking members 44 and receiving slots 46 together. More specifically, tacking members 44 of one framing member are securely received in adjacent receiving slots 46 of the other framing member for securely holding expandable accordion-like adjustable walls together.

Adjustable frame 10 may be selectively adjusted both length-wise and width-wise to accommodate pictures having a variety of dimensions. Furthermore, adjustable frame 10 may be adjusted in one direction without altering the dimensions in the other direction. More specifically, for selective length-wise adjustment, the series of vertical expandable accordion-like wall portions 38*a* and 38*b* are positioned and secured together to adjust the length of adjustable frame 10. Similarly, for width-wise adjustment, the series of horizontal expandable wall portions 38*c* and 38*d* are positioned and secured together to adjust the width of adjustable frame 10.

For re-use of adjustable frame 10 with subsequent pictures, the original pictures are removed and the steps noted above are repeated.

In view of the foregoing, it will be seen that several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all material contained in the foregoing description or shown in the accompanying drawings should be interpreted as illustrative rather than limiting.

I claim:

1. An adjustable picture frame comprising:

a first framing member having a series of interconnected adjustable walls defining an opening for displaying a picture, wherein the adjustable walls are for adjustably fitting over a plurality of portions of a display means;

a second framing member having a series of interconnected adjustable walls defining an opening for displaying a picture, wherein the adjustable walls are for adjustably fitting over a plurality of portions of a display means;

means for fastening the adjustable walls of the first framing member to the adjustable walls of the second framing member;

means for displaying a picture between the first and second framing members; and means for selectively positioning the display means between the first and second framing members in a plurality of positions, wherein the selective positioning means are integrally located on at least one of the framing members, the selective positioning means comprising at least one locator grid integrally formed on at least one of the first and second framing members, the locator grid having a series of receiving holes, and at least one locator pin on the display means, the locator pin adapted for being received in the series of receiving holes, wherein the locator pin positions the display means in the plurality of positions within the adjustable picture frame.

2. An adjustable picture frame comprising:

a first framing member having a series of interconnected adjustable walls defining an opening for displaying a picture, the series of interconnected adjustable walls comprising accordion-like expandable folds, wherein the adjustable walls are for adjustably fitting over a plurality of portions of a display means;

a second framing member having a series of interconnected adjustable walls defining an opening for displaying a picture, the series of interconnected adjustable walls comprising accordion-like expandable folds, wherein the adjustable walls are for adjustably fitting over a plurality of portions of a display means;

means for fastening the adjustable walls of the first framing member to the adjustable walls of the second framing member;

means for displaying a picture between the first and second framing members; and means for selectively positioning the display means between the first and second framing members in a plurality of positions, wherein the selective positioning means are integrally located on at least one of the framing members.

3. The adjustable picture frame of claim 2, wherein the accordion-like expandable folds include internal hinges.

* * * * *